US012520873B2

(12) United States Patent
Liu

(10) Patent No.: US 12,520,873 B2
(45) Date of Patent: Jan. 13, 2026

(54) CERAMIC HEATING CORE, ATOMIZER COMPRISING THE SAME, AND ELECTRONIC CIGARETTE COMPRISING THE ATOMIZER

(71) Applicant: ASPIRE NORTH AMERICA LLC, Los Angeles, CA (US)

(72) Inventor: Tuanfang Liu, Shenzhen (CN)

(73) Assignee: Aspire North America LLC, Venice, CA (US)

( * ) Notice: Subject to any disclaimer, the term of this patent is extended or adjusted under 35 U.S.C. 154(b) by 531 days.

(21) Appl. No.: 17/951,055

(22) Filed: Sep. 22, 2022

(65) Prior Publication Data

US 2024/0032601 A1 Feb. 1, 2024

(30) Foreign Application Priority Data

Jul. 29, 2022 (CN) ..... 202210904652.2
Jul. 29, 2022 (CN) ..... 202221989633.6

(51) Int. Cl.
*A24F 40/46* (2020.01)
*A24F 40/10* (2020.01)
*A24F 40/57* (2020.01)

(52) U.S. Cl.
CPC ..... *A24F 40/46* (2020.01); *A24F 40/10* (2020.01); *A24F 40/57* (2020.01)

(58) Field of Classification Search
CPC ..... A24F 40/46
See application file for complete search history.

(56) References Cited

U.S. PATENT DOCUMENTS

2022/0167678 A1* 6/2022 Warren ..... A24F 40/40

FOREIGN PATENT DOCUMENTS

| | | | | |
|---|---|---|---|---|
| CA | 3097349 A1 | * | 10/2019 | ..... B33Y 30/00 |
| CN | 105852218 A | * | 8/2016 | ..... A24F 40/465 |
| CN | 112493556 A | * | 3/2021 | ..... A24F 40/46 |
| CN | 215347010 U | * | 12/2021 | ..... A24F 40/44 |

OTHER PUBLICATIONS

Translation of CN 112493556 (Year: 2021).*

* cited by examiner

*Primary Examiner* — Cynthia Szewczyk
(74) *Attorney, Agent, or Firm* — Harter Secrest & Emery LLP

(57) ABSTRACT

A ceramic heating core includes a ceramic body and at least one heating wire. The ceramic body includes at least one through hole, and the at least one heating wire is disposed through the at least one through hole. The at least one heating wire each includes an effective heating section; the effective heating section extends helically in the through hole; the effective heating section includes a plurality of helical coils, and there is a space between every two adjacent helical coils; defining a helical direction of the plurality of helical coils as an axial direction, the effective heating section has an axial height of 3-6 mm; and the ceramic body has an axial height of ≥7.5 mm.

15 Claims, 11 Drawing Sheets

CERAMIC HEATING CORE, ATOMIZER COMPRISING THE SAME, AND ELECTRONIC CIGARETTE COMPRISING THE ATOMIZER

CROSS-REFERENCE TO RELATED APPLICATIONS

Pursuant to 35 U.S.C.§ 119 and the Paris Convention Treaty, this application claims foreign priority to Chinese Patent Application No. 202210904652.2 filed Jul. 29, 2022, and to Chinese Patent Application No. 202221989633.6 filed Jul. 29, 2022. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to a ceramic heating core, an atomizer comprising the ceramic heating core, and an electronic cigarette comprising the atomizer.

A conventional ceramic heating core is spiral and is disposed on the inner wall of the ceramic body of the heating wire. Usually, the effective heating section of the heating wire is 2 mm, and the height of the ceramic body is 6 mm. Because the effective heating section of the heating wire is centralized, the heat is concentrated, and the local atomization temperature is high, which tends to cause the e-liquid molecules to react affecting their taste. In addition, because the height of the ceramic body is 6 mm, and the e-liquid storage amount is limited, the heating wire does not replenish the e-liquid timely and adequately, the atomization amount is small, the taste is poor, and e-liquid leakage is easy to occur.

SUMMARY

The disclosure provides a ceramic heating core, comprising a ceramic body and at least one heating wire. The ceramic body comprises at least one through hole, and the at least one heating wire is disposed through the at least one through hole. The at least one heating wire each comprises an effective heating section; the effective heating section extends helically in the through hole; the effective heating section comprises a plurality of helical coils, and there is a space between every two adjacent helical coils; defining a helical direction of the plurality of helical coils as an axial direction, the effective heating section has an axial height of 3-6 mm; and the ceramic body has an axial height of ≥7.5 mm.

In a class of this embodiment, the ceramic body has an axial height of 7.5-9 mm.

In a class of this embodiment, the ceramic body has an axial height of 7.8-8.2 mm.

In a class of this embodiment, the ceramic body has an axial height of 3.5-4.7 mm.

In a class of this embodiment, the ceramic body has an axial height of 3.5-4.5 mm.

In a class of this embodiment, the effective heating section comprises 2.5-5.5 helical coils.

In a class of this embodiment, each effective heating section comprises at least one heating monofilament; effective heating sections of the ceramic heating core are in parallel connection to each other, and a total resistance of the effective heating sections connected in parallel is 0.5-1.8Ω.

In a class of this embodiment, the ceramic body comprises one through hole; the effective heating section in the one through hole comprises two parallel-connected heating monofilaments; and the effective heating section has an axial height of 3.7-4.3 mm.

In a class of this embodiment, the one through hole has a diameter of 1.3-1.7 mm; the effective heating section comprises 4.3-5.5 helical coils; and the total resistance of the effective heating section connected in parallel is 0.5-1.8Ω.

In a class of this embodiment, the one through hole has a diameter of 1.4-1.6 mm; the effective heating section comprises 4.7-5.3 helical coils; and the total resistance of the effective heating section connected in parallel is 1.5-1.7Ω.

In a class of this embodiment, the one through hole has a diameter of 1.8-2.2 mm; the effective heating section comprises 2.5-4.2 helical coils; and the total resistance of the effective heating section connected in parallel is 1.1-1.4Ω.

In a class of this embodiment, the one through hole has a diameter of 1.9-2.1 mm; the effective heating section comprises 2.6-3.0 helical coils; and the total resistance of the effective heating section connected in parallel is 1.2-1.4Ω.

In a class of this embodiment, the one through hole has a diameter of 1.9-2.1 mm; the effective heating section comprises 3.7-4.2 helical coils; and the total resistance of the effective heating section connected in parallel is 1.2-1.4Ω.

In a class of this embodiment, the ceramic body comprises two through holes; the effective heating section in each of the two through holes comprises a heating monofilament; and heating monofilaments are disposed in parallel.

In a class of this embodiment, the one through hole has a diameter of 1.8-2.2 mm; the effective heating section comprises 2.5-4.0 helical coils; and the total resistance of the effective heating section connected in parallel is 0.5-1.2Ω.

In a class of this embodiment, the one through hole has a diameter of 1.9-2.1 mm; the effective heating section comprises 3.7-4.2 helical coils; the effective heating section comprises 3.2-3.8 helical coils; and the total resistance of the effective heating section connected in parallel is 0.5-0.8Ω.

In a class of this embodiment, the one through hole has a diameter of 1.9-2.1 mm; the effective heating section comprises 4.0-4.5 helical coils; the effective heating section comprises 2.8-3.0 helical coils; and the total resistance of the effective heating section connected in parallel is 0.9-1.2Ω.

In a class of this embodiment, two ends of the effective heating section are connected to a first pin and a second pin through solder joints, respectively; and a resistivity of the heating monofilament is 10-100 times that of the first pin or the second pin.

In a class of this embodiment, the heating monofilament abuts against an inner wall of the ceramic body; or at least two thirds of the heating monofilament are embedded in the inner wall of the ceramic body.

In another aspect, the disclosure provides an atomizer, comprising the ceramic heating core.

In further another aspect, the disclosure provides an electronic cigarette comprising the ceramic heating core.

The following advantages are associated with the ceramic heating core, the atomizer and the electronic cigarette comprising the same of the disclosure. The effective heating section of the ceramic heating core plays a role of resistor and the axial height thereof is up to 3-6 mm with the resistance unchanged, so that the distance between adjacent helical coils becomes larger, the heat distribution area increases, the atomization temperature is uniform and appropriate, and the taste is good, and the problem that high temperature destroys the e-liquid molecules and leads to bad taste is solved. The height of the ceramic body is extended from 6 mm to 7.5 mm, which increases the e-liquid storage capacity, so that there is enough e-liquid to supplement the heating wire, improving the taste, increasing the atomization amount, increasing the flow resistance to the e-liquid chamber, and reducing the risk of oil leakage.

DETAILED DESCRIPTION

To further illustrate the disclosure, embodiments detailing a ceramic heating core, an atomizer and an electronic cigarette comprising the same are described below. It should be noted that the following embodiments are intended to describe and not to limit the disclosure.

Figure 1:
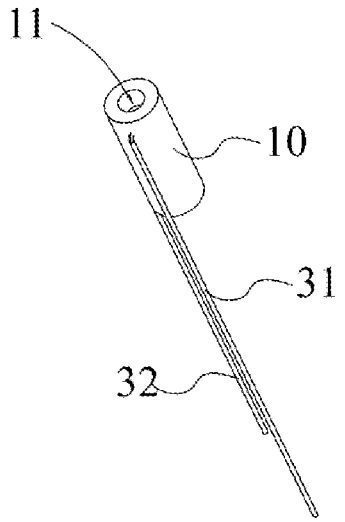
FIG. 1 is a schematic diagram of a ceramic heating core comprising one through hole according to one embodiment of the disclosure.

As shown in FIGS. 1-7, to solve the problem that the effective heating section of a conventional heating wire 21 is centralized, the produced heat is focused and thus the local atomization temperature is high, which destroys the e-liquid molecules and affect the taste, the disclosure provides a ceramic heating core, comprising a ceramic body 10, the ceramic body comprising at least one through hole 11; at least one heating wire 21 is disposed through the at least one through hole 11. The at least one heating wire each comprises an effective heating section 23; the effective heating section 23 extends helically in the through hole; the effective heating section 23 comprises a plurality of helical coils 24, and there is a space d1 between every two adjacent helical coils; defining a helical direction of the plurality of helical coils as an axial direction, the effective heating section has an axial height d2 of 3-6 mm; and the ceramic body has an axial height D3 of ≥7.5 mm. In general, each of the through holes is provided with a heating wire 21. The heating wire 21 comprises a first pin 31 and a second pin 32. The effective heating section 23 generates heat for heating the e-liquid after being energized. The first pin 31 and the second pin 32 play a conductive role. The effective heating section 23 comprises at least one heating monofilament 231 connected in parallel. As shown in FIG. 1, the ceramic body 10 is substantially cylindrical, and the cross section of the through hole 11 is also substantially circular, which is not detailed herein.

The effective heating section plays a role of resistor and the axial height thereof is up to 3-6 mm, so that the distance between adjacent helical coils becomes larger, the heat distribution area increases, the atomization temperature is uniform and appropriate, and the taste is good, and the problem that high temperature destroys the e-liquid molecules and leads to bad taste is solved. The height of the ceramic body becomes longer, which increases the e-liquid storage capacity, so that there is enough e-liquid to supplement the heating wire, improving the taste, increasing the atomization amount, increasing the flow resistance to the e-liquid chamber, and reducing the risk of oil leakage.

Figure 3:
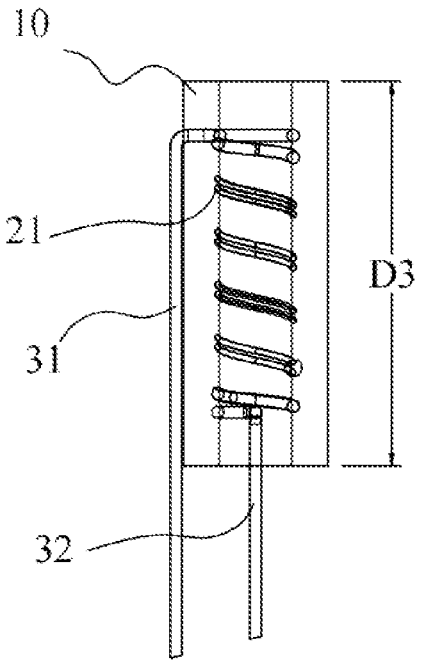
FIG. 3 is a sectional view of a ceramic heating core according to one embodiment of the disclosure.

As shown in FIGS. 1 and 3, the ceramic body 10 comprise a through hole 11. The through hole 11 is an air channel, and the ceramic body 10 is used to absorb the e-liquid. The effective heating section 23 evaporates the e-liquid and the produced vapor flows out via the through hole 11. Thus, the ceramic body 10 is not only used as an e-liquid guide, but also a support for the heating wire 21. Meanwhile, to support the helical heating wire 21, the ceramic body 10 with a compressive strength greater than 1.5 kg/30 s is selected in this disclosure. Compared with the conventional cotton core structure, the ceramic body 10 has a simple structure and high e-liquid discharge efficiency. To ensure the penetration efficiency of the e-liquid, the ceramic elements with porosity of 46%-56%, water absorption of 38-48% and pore diameter of about 6-10 um are selected and processed by pressing, pouring, stamping, or wax loss.

Further, the height D3 of the ceramic body 10 is limited to 7.5 mm-9 mm; more preferably, the height D3 of the ceramic body 10 is limited to 7.8 mm-8.2 mm. Compared with the height of the ceramic body 10 in the prior art, which is usually 6 mm, the e-liquid storage capacity of the disclosed ceramic heating core is improved, especially the thicker e-liquid can be sufficiently supplied to the heating wire 21. In addition, the conventional problem that the height D3 of the ceramic body 10 is too high and the vapor flow is not smooth is avoided in the disclosure.

In certain embodiments, the height D3 of the ceramic body 10 may be 7.5 mm, 7.6 mm, 7.7 mm, 7.8 mm, 7.85 mm, 7.9 MM, 7.95 mm, 8.0 mm, 8.05 mm, 8.1 mm, 8.15 mm, 8.2 mm, 8.3 mm, 8.4 mm, 8.5 mm, 9 mm, etc.

Figure 2:
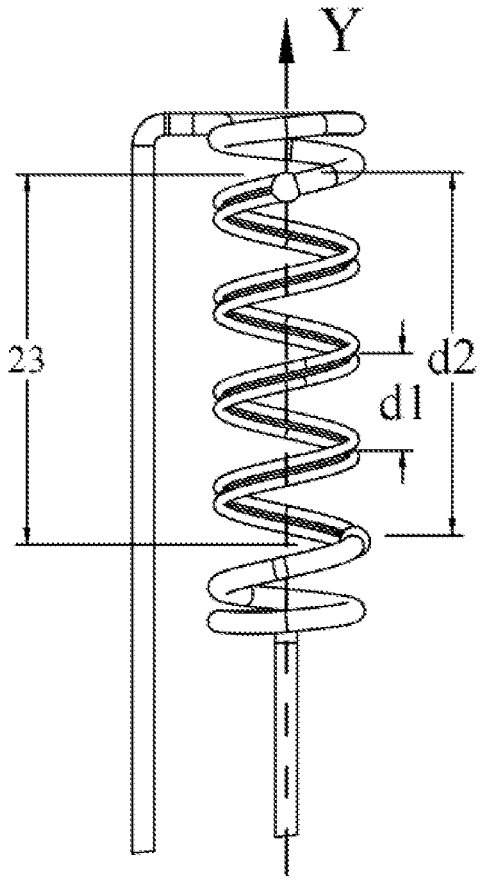
FIG. 2 shows a structural dimension of a heating wire according to one embodiment of the disclosure.

As shown in FIG. 2, further, the height D2 of the helical effective heating section 23 along the longitudinal axis Y is 3.5 mm-4.7 mm, and more preferably, the height D2 of the helical effective heating section 23 along the longitudinal axis Y is 3.7 mm-4.5 mm. The effective heating segment 23 is designed within this range. Compared with the 2 mm height in the prior art, the effective heating segment 23 can be more evenly distributed. Under the same conditions, the higher the height of the effective heating segment, the larger the space of two adjacent helices, the better the heat dissipation effect, and the better the atomization amount and the taste effect. At the same time, the effective heating segment 23 should not be stretched too high to cause deformation and affect the effect.

As shown in FIG. 2, in some embodiments, the height D2 of the helical effective heating segment 23 along the longitudinal axis Y may be 3 mm, 3.5 mm, 3.6 mm, 3.7 mm, 3.8 mm, 3.9 mm, 4.0 mm, 4.1 mm, 4.2 mm, 4.3 mm, 4.4 mm, 4.5 mm, 4.6 mm, 4.7 MM, 5.0 mm, 5.5 mm, 6.0 mm, etc.

Figure 4:
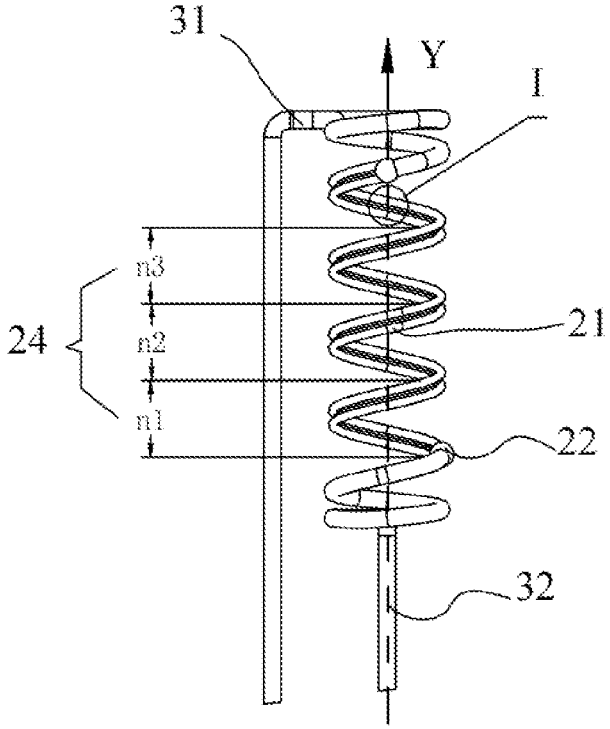
FIG. 4 is a schematic diagram of a heating wire according to one embodiment of the disclosure.

As shown in FIG. 4, the number of turns of the helical coils 24 of the effective heating section 23 is between 2.5 and 5.5 (n1, n2, and n3 are sequentially marked in the drawing for convenience of indicating the number of turns of the effective heating section 23). In some embodiments, for example, the number of turns of the helical coils may be 2.5, 2.6, 2.7, 2.8, 2.9, 3.0, 3.1, 3.2, 3.3, 3.4, 3.5, 3.6, 3.7, 3.8 3.9, 4.0, 4.1, 4.2, 4.3, 4.4, 4.5, 4.6, 4.7, 4.8, 4.9, 5.0, 5.1, 5.2, 5.3, 5.4, 5.5.

As shown in FIG. 2, in some embodiments, the distance d1 between adjacent helical coils 24 is larger than usual, which improves the heat dissipation effect, further avoids the local temperature from being too high, and at the same time, the heat is evenly distributed, and the vapor taste becomes more gentle and soft. In addition, when the distance d1 between adjacent helical coils 24 is larger than usual, and the effective heating section 23 per unit height has a higher utilization rate of the e-liquid and a larger vapor volume, further improving the taste of vapor.

Figure 6:
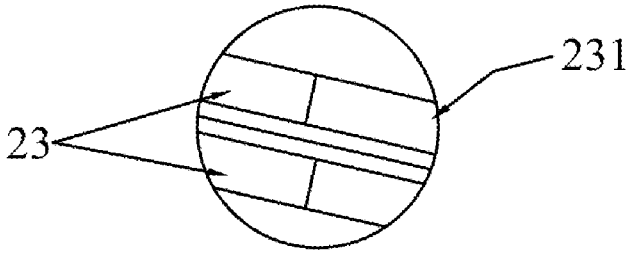
FIG. 6 is a local enlarged view of part I in FIG. 3.

As shown in FIG. 6, each effective heating section 23 comprises at least one heating monofilament 231; the effective heating sections 23 of the ceramic heating core are in parallel connection to each other, and the total resistance of the effective heating sections 23 connected in parallel is 0.5-1.8Ω.

In certain embodiments, the effective heating section 23 comprises a plurality of heating filaments 231, and the heating filaments 231 are disposed side by side with each other, and then connected in parallel. The heating filaments 231 may be connected side by side with each other by welding, or may be in close contact with each other in parallel, or may be wound around each other as the effective heating section 23. An included angle and a distance are formed between the adjacent helical coils 24 of the effective heating section 23 after the heating wires 231 are in parallel connected together. In other embodiments, each effective heating section 23 comprises one heating monofilament, and each heating monofilament 231 is distributed in a corresponding through holes 11. The heating monofilaments 231 are connected in parallel with each other, and an included angle and spacing are formed between adjacent helical coils 24 of the heating monofilament 231. Understandably, the effective heating section 23 comprises the heating monofilaments 231 connected in parallel, which can effectively withstand higher power, increase the thermal amount, and reduce the problems such as dry burn caused by too fast heating and not timely replenishment of the e-liquid. At the same time, the ceramic heating core features uniform heating, thus reducing the formation of harmful chemical substances caused by temperature change.

For example, the resistance of the effective heating section 23 may be 0.5 Ω, 0.6 Ω, 0.7 Ω, 0.8 Ω, 0.9 Ω, 1.0 Ω, 1.1 Ω, 1.2 Ω, 1.3 Ω, 1.4 Ω, 1.5 Ω, 1.6 Ω, 1.7 Ω, 1.8Ω, etc.

Figure 5:
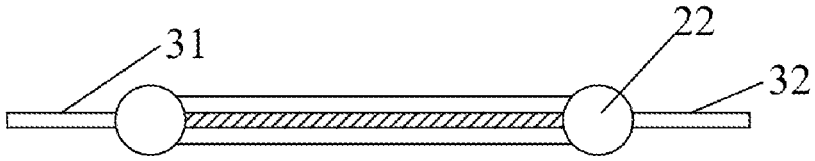
FIG. 5 is a schematic diagram of a heating wire in a non-helical state according to one embodiment of the disclosure

As shown in FIG. 5, the heating wire 21 further comprises a first pin 31 and a second pin 32. Both ends of the effective heating section 23 are connected to the first pin 31 and the second pin 32 through solder joints 22, respectively, and form a circuit. Optionally, the first pin 31 and the second pin 32 may be linear or helical, as needed. The first pin 31 is connected to a positive electrode or a negative electrode, and correspondingly, the second pin 32 is connected to a negative electrode or a positive electrode. One heating wire 21 is provided in each through hole 11. The heating wire 21 comprises one effective heating section 23, one first pin 31, and one second pin 32. In some embodiments, the effective heating section 23 comprises a plurality of parallel heating monofilaments 231, and the first pin 31 and the second pin 32 are respectively connected to the plurality of heating monofilaments 231 at the same time. In other embodiments, the effective heating section 23 comprises a heating monofilament 231, and the first pin 31 and the second pin 32 are connected to the heating monofilament 231.

The two ends of the effective heating section 23 are connected to the first pin 31 and the second pin 32 through the solder joints 22. The resistivity of the heating wire 231 is 10-100 times that of the first pin 31 or the second pin 32, which reduces the influence of the pins on the overall resistance of the heating wire 231. Controlling the resistance of the effective heating section 23, the diameter (equivalent to the inner diameter of the ceramic tube of the disclosure) of the helical coils of the effective heating section 23 and the length of the effective heating section 23 can reduce the influence of the pin length on the overall scheme.

In certain embodiments, the heating monofilament abuts against the inner wall of the ceramic body 10. The inner wall forms the through hole. In other embodiments, part of the heating monofilament is embedded in the inner wall. Specifically, at least two thirds of the heating monofilament are embedded in the inner wall of the ceramic body, and the heating monofilament 231 obtains the e-liquid from the ceramic body 10. The part of heating monofilament exposed out of the inner wall increases the vapor amount, thus improving the taste.

In certain embodiments, the ceramic body 10 is provided with a through hole 11. A heating wire 21 is disposed in the through-hole 11. The effective heating section 23 of the heating wire 21 comprises two parallel-connected heating monofilaments 231. A first pin 31 and a second pin 32 are connected to both ends of the heating monofilament 231, respectively.

The height of the effective heating section 23 along the longitudinal axis Y is 3.7 mm-4.3 mm. In some examples, the height of the effective heating segment 23 along the longitudinal axis Y is 3.7 mm-4.3 mm. The diameter of the through hole 11 is 1.3-1.7 mm, preferably 1.4-1.6 mm. The number of turns of the effective heating section 23 is 4.3-5.5, preferably 4.7-5.3. The total resistance of the effective heating section 23 is 1.5-1.8Ω, preferably 1.5-1.7Ω. In other examples, the height of the effective heating segment 23 along the longitudinal axis Y is 3.7 mm-4.3 mm, and the diameter of the through hole 11 is 1.8-2.2 mm, preferably 1.9-2.1 mm. The number of turns of the effective heating section 23 is 2.5-4.2, preferably 2.6-3.0. The total resistance of the effective heating section 23 is 1.1-1.4Ω, preferably 1.2-1.4Ω. In other examples, the height of the effective heating segment 23 along the longitudinal axis Y is 3.7 mm-4.3 mm, the diameter of the through hole 11 is 1.9-2.1 mm, the number of turns of the effective heating segment 23 is 3.7-4.2, and the total resistance of the effective heating segment 23 is 1.2-1.4Ω.

In other embodiments, the ceramic body 10 comprises two through holes 11. Each through hole 11 is provided with a heating wire 21. Each heating wire 21 comprises a first pin 31, a second pin 32, and a heating monofilament 231. Both ends of the heating monofilament 231 are connected to the first pin 31 and the second pin 32, respectively. In some examples, the height of the effective heating segment 23 along the longitudinal axis is 3.7 mm-4.2 mm, and the diameter of each of the through holes 11 is 1.8-2.2 mm, preferably 1.9-2.1 mm. The number of turns of the effective heating section 23 is 2.5-4.0 turns, preferably 3.2-3.8 turns. When the two heating wires 21 are connected in parallel, the total resistance of the effective heating section 23 is 0.5-1.2Ω, preferably 0.5-0.8Ω. In other examples, the height of the effective heating segment 23 along the longitudinal axis is 4.0 mm-4.5 mm, and the diameter of each of the through holes 11 is 1.8-2.2 mm, preferably 1.9-2.1 mm. The number of turns of the effective heating section 23 is 2.5-4.0, preferably 2.8-3.0. When the two heating wires 21 are connected in parallel, the total resistance of the effective heating section 23 is 0.5-1.2Ω, preferably 0.9-1.2Ω.

Specifically, embodiments of the disclosure will be described with reference to the accompanying drawings, which are only for understanding but are not limited the disclosure.

Example 1

As shown in FIGS. 1-7, a ceramic heating core of this example comprises a ceramic body 10 and a heating wire 21. The ceramic body 10 comprises one through hole 11 along the axial direction of the ceramic body; and the heating wire 21 is disposed through the through hole 11. The through hole 11 is an air channel. The ceramic body 10 is used to absorb e-liquid, the height D3 of the ceramic body 10 is 8.0±0.1 mm, and the diameter φ1 of the cross section of the ceramic body 10 is 3.0±0.1 mm, and the diameter φ2 (diameter of the air passage) of the through hole 11 is 1.5±0.1 mm. The ceramic body 10 is made of microporous ceramics. The pore diameter of the micropores is about 8 μm. The micropore is convenient for the flow of the e-liquid. When leaving the factory, it is necessary to check whether the appearance of the ceramic body is clean, free of sharp edges, dirt, defects, cracks and other technical problems; the ceramic body has good e-liquid absorption and stable chemical properties.

The heating wire 21 of this example comprises an effective heating section 23, a first pin 31, and a second pin 32. The effective heating section 23 is formed by welding two heating monofilaments 231 together. The first pin 31 and the second pin 32 are respectively connected to both ends of the effective heating section 23 through the solder joint 22, that is, the first pin 31 and the second pin 32 are respectively connected to both ends of the two heating monofilaments 231. The effective heating section 23 is helical. The part of the first pin 31 and the second pin 32 respectively connected to the effective heating section 23 is also in a helical shape, and the rest is led out from the helical shape in two parallel straight lines. The wire diameter of the heating monofilament 231 is 0.12±0.003 mm, the resistance of the heating monofilament 231 is 3.2±0.1Ω, and the total resistance of the effective heating section 23 when the two heating monofilaments 231 are welded together is about 1.6±0.1Ω. The heating monofilament 231 is made of a metal with a high resistivity, including but not limited to various alloy materials, such as iron chromium aluminum alloy. The first pin 31 and the second pin 32 are made of a metal having a low resistivity, such as nickel, aluminum, copper, tungsten, iron, and the like. The wire diameter of the first pin 31 and the second pin 32 is 0.25±0.15 mm.

Apart of the heating monofilament 231 along the cross-sectional direction is embedded in the inner wall of the ceramic body 10 corresponding to the through hole 11, and the exposed part of the heating monofilament 231 out of the inner wall does not exceed ⅓ of the wire diameter (that is, the thickness of the heating monofilament 231 exposed to the ceramic core does not exceed about 0.04 mm).

The effective heating section 23 extends helically in the longitudinal axis direction in the through hole 11. The effective heating section 23 is partially embedded in the inner wall of the ceramic body 10 corresponding to the through hole 11. The height D2 of the effective heating section 23 along the longitudinal axis is 4.0±0.3 mm. The effective heating section 23 comprises multiple turns of helical coil 24, the number of turns of the helical coil 24 is 4.4±0.2, and the spacing D1 between adjacent two turns of coil 24 is about 0.9±0.2 mm.

Example 2

Figure 8:
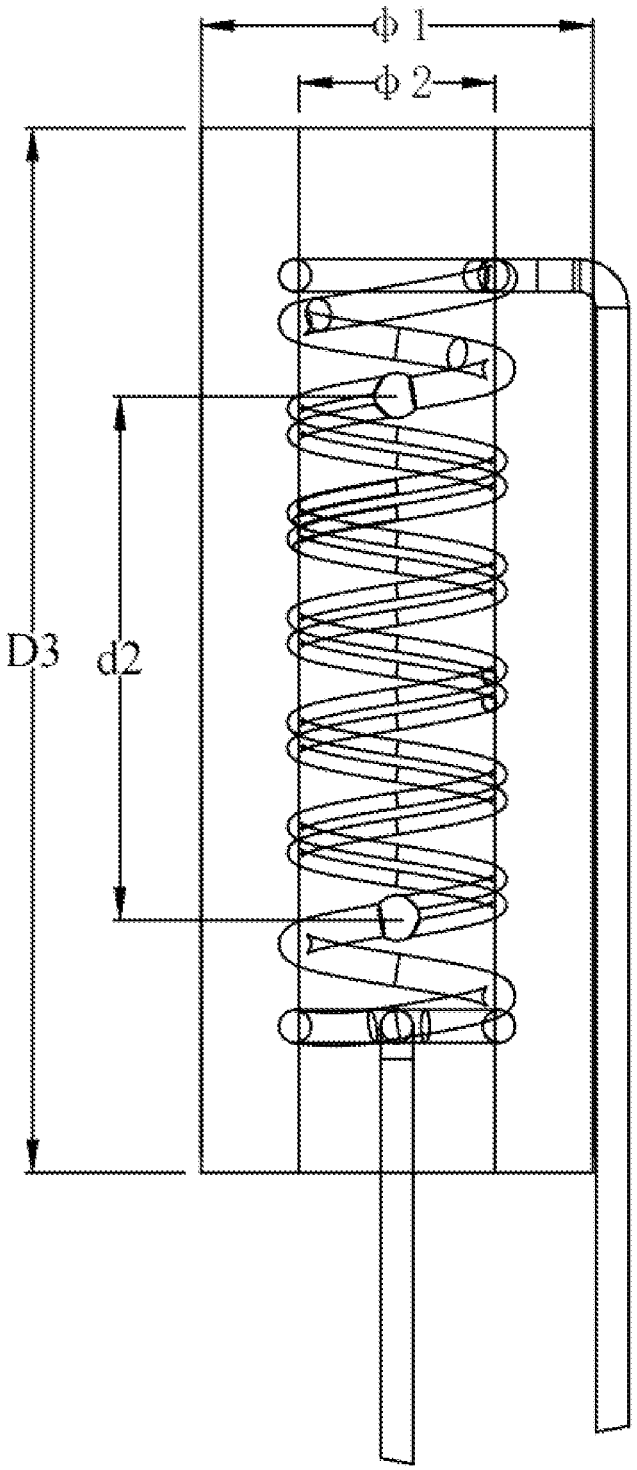
FIG. 8 is a schematic diagram of a ceramic heating core in Example 2.

As shown in FIG. 8, this example is different from example 1 in that the number of turns of the helical heating coils 24 of the effective heating section 23 is increased to 5.0±0.2 turns. The distance d1 between two adjacent heating coils 24 is about 0.8±0.2 mm. Others are unchanged and will not be repeated here.

Example 3

Figure 7:
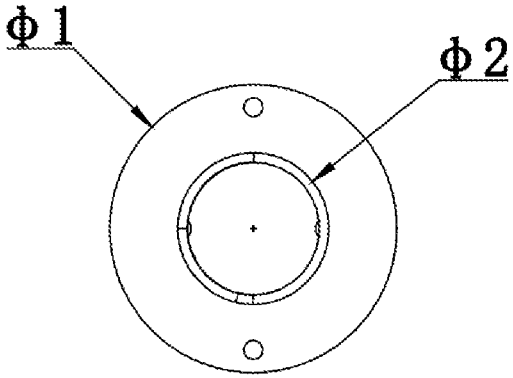
FIG. 7 is a top view of a ceramic heating core comprising one through hole according to one embodiment of the disclosure.
Figure 9:
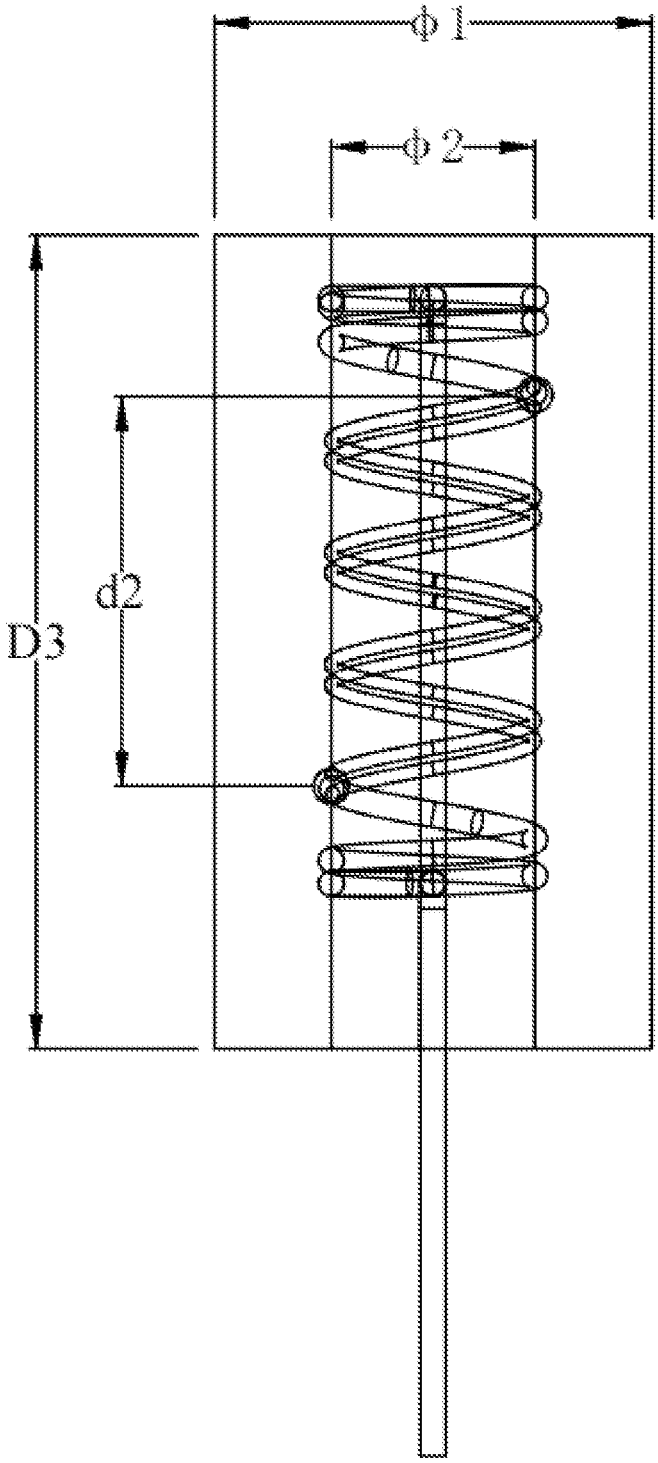
FIG. 9 is a schematic diagram of a ceramic heating core in Example 3.

As shown in FIGS. 7 and 9, this example is different from example 1 is that the diameter φ1 of the cross section of the ceramic body 10 increases to 4.3±0.1 mm, and the diameter φ2 of the through hole 11 increases to 2.0±0.1 mm.

The number of turns of the helical heating coil 24 of the effective heating section 23 is increased to 3.9±0.2. The distance d1 between two adjacent heating coils 24 is about 1.0±0.2 mm.

The wire diameter of the heating monofilament 231 of the effective heating section 23 is 0.14±0.003 mm, the resistance of the heating monofilament 231 is 2.6±0.1Ω, and when the two heating monofilaments 231 are welded together, the total resistance of the effective heating section 23 is about 1.3±0.1Ω. Others are unchanged and will not be repeated here.

Example 4

Figure 10:
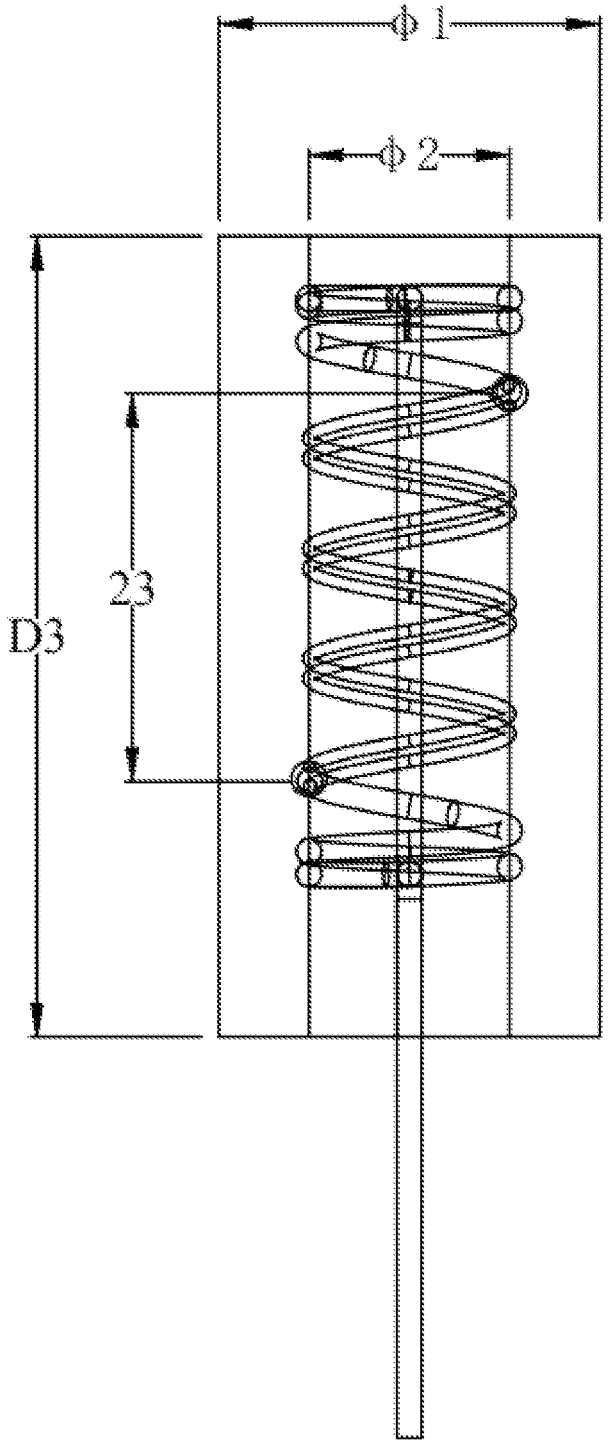
FIG. 10 is a schematic diagram of a ceramic heating core in Example 4.

As shown in FIG. 10, this example is different from example 1 is that the diameter φ1 of the cross section of the ceramic body 10 increases to 3.8±0.05 mm, and the diameter φ2 of the through hole 11 increases to 2.0±0.05 mm.

The number of turns of the helical heating coil 24 of the effective heating section 23 is increased to 2.8±0.2. The distance d1 between two adjacent heating coils 24 is about 1.4±0.2 mm.

The wire diameter of the heating monofilament 231 of the effective heating section 23 is 0.12±0.003 mm, the resistance of the heating monofilament 231 is 2.6±0.1Ω, and when the two heating monofilaments 231 are welded together, the total resistance of the effective heating section 23 is about 1.3±0.1Ω. Others are unchanged and will not be repeated here.

Example 5

Figure 11:
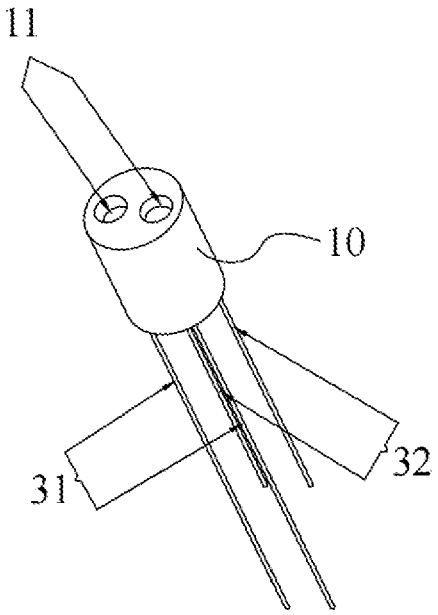
FIG. 11 is a schematic diagram of a ceramic heating core comprising two through holes according to one embodiment of the disclosure.
Figure 12:
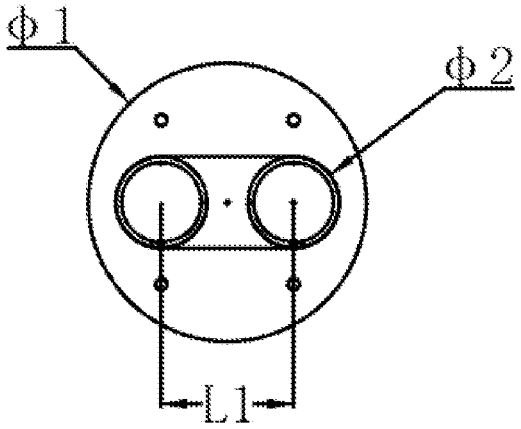
FIG. 12 is a top view of a ceramic heating core comprising two through holes according to one embodiment of the disclosure.
Figure 13:
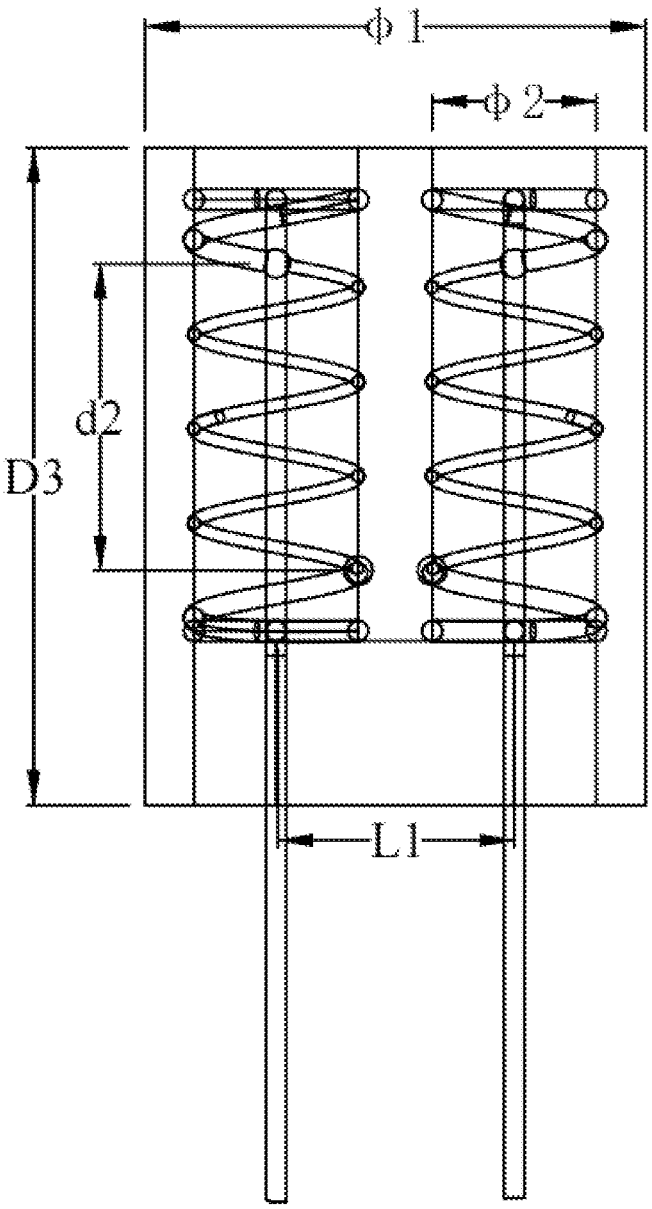
FIG. 13 is a schematic diagram of a ceramic heating core in Example 5.

As shown in FIGS. 11-13, a ceramic heating of this example comprises a ceramic body 10 and a heating wire 21. The ceramic body 10 comprises two through holes 11 along the axial direction of the ceramic body; and a heating wire 21 is disposed through each of the two through holes 11. The through hole 11 is an air channel. The ceramic body 10 is used to absorb e-liquid, the height D3 of the ceramic body 10 is 8.0±0.1 mm, and the diameter φ1 of the cross section of the ceramic body 10 is 6.1±0.1 mm. The through holes 11 are all round, and the centers of the two through holes 11 are in a line of a diameter of the ceramic body 10, which is centrosymmetrical. The diameter φ2 (air channel diameter) of the through holes 11 is 2.0±0.1 mm, and the center to center distance L1 of the two through holes 11 is 2.9±0.1 mm.

The ceramic body 10 is made of microporous ceramics. The pore diameter of the micropores is about 8 μm. The micropores are convenient for the flow of the e-liquid. When leaving the factory, it is necessary to check whether the appearance of the ceramic body is clean, free of sharp edges, dirt, defects, cracks and other technical problems; the ceramic body has good e-liquid absorption and stable chemical properties.

The heating wire 21 of this example comprises an effective heating section 23, a first pin 31, and a second pin 32. The effective heating section 23 is formed by welding two heating monofilaments 231 together. The first pin 31 and the second pin 32 are respectively connected to both ends of the effective heating section 23 through the solder joint 22. The effective heating section 23 is helical. The part of the first pin 31 and the second pin 32 respectively connected to the effective heating section 23 is also in a helical shape, and the rest is led out from the helical shape in two parallel straight lines. The wire diameter of the heating monofilament 231 is 0.18±0.003 mm, the resistance of the heating monofilament 231 is 1.4±0.1Ω, and the total resistance of the effective heating section 23 when the two heating monofilaments 231 are welded together is about 0.7±0.1Ω. The heating monofilament 231 is made of a metal with a high resistivity, including but not limited to various alloy materials, such as iron chromium aluminum alloy. The first pin 31 and the second pin 32 are made of a metal having a low resistivity, such as nickel, aluminum, copper, tungsten, iron, and the like. The wire diameter of the first pin 31 and the second pin 32 is 0.25±0.15 mm.

A part of the heating monofilament 231 along the cross-sectional direction is embedded in the inner wall of the ceramic body 10 corresponding to the through hole 11, and the exposed part of the heating monofilament 231 out of the inner wall does not exceed ⅓ of the wire diameter (that is, the thickness of the heating monofilament 231 exposed to the ceramic core does not exceed about 0.06 mm).

The effective heating section 23 extends helically in the longitudinal axis direction in the through hole 11. The effective heating section 23 is partially embedded in the inner wall of the ceramic body 10 corresponding to the through hole 11. The height D2 of the effective heating section 23 along the longitudinal axis is 4.0±0.3 mm. The effective heating section 23 comprises multiple turns of helical coil 24, the number of turns of the helical coil 24 is 3.5±0.2, and the spacing D1 between adjacent two turns of coil 24 is about 1.1±0.1 mm.

Example 6

Figure 14:
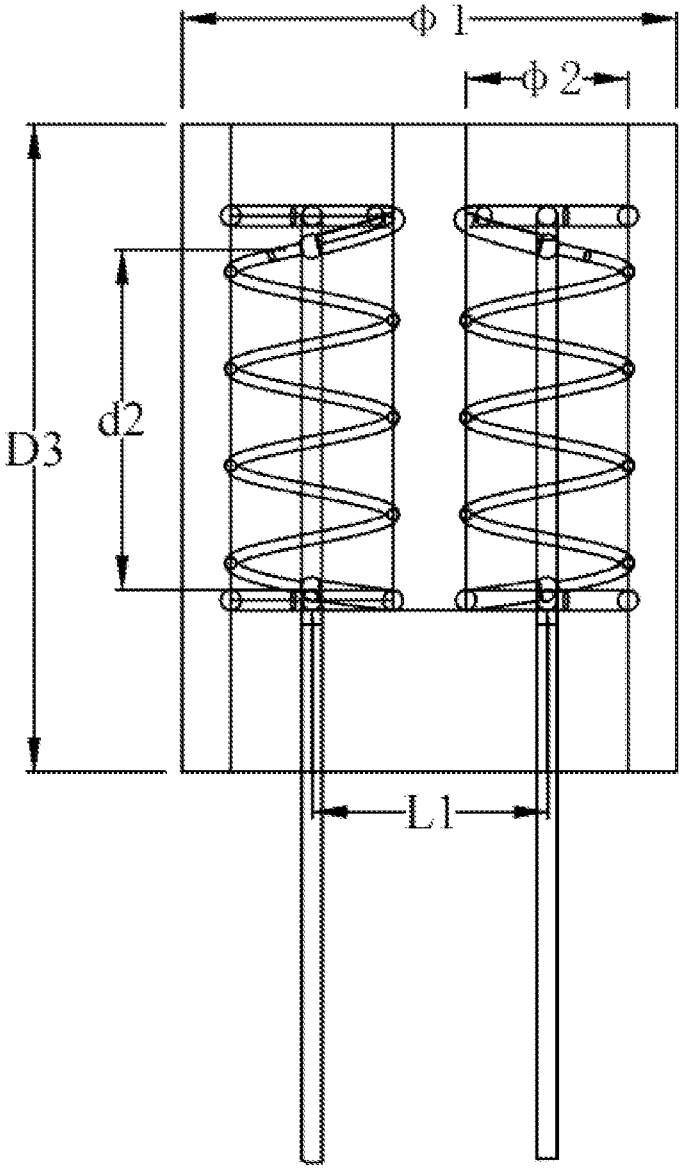
FIG. 14 is a schematic diagram of a ceramic heating core in Example 6.

As shown in FIG. 14, the ceramic body 10 comprises two through holes 11. Each through hole 11 is provided with a heating wire 21. The effective heating section 23 of the heating wire 21 comprises a heating monofilament 231. The difference from example 5 is that the height of the effective heating section 23 is 4.2±0.3 mm, and the number of turns of the helical heating coil 24 of the effective heating section 23 is 2.9±0.1. The distance d1 between two adjacent heating coils 24 is about 1.45±0.2 mm.

The wire diameter of the heating monofilament 231 of the effective heating section 23 is 0.14±0.003 mm, the resistance of the heating monofilament 231 is 2.0±0.1Ω, and when the two heating monofilaments 231 are welded together, the total resistance of the effective heating section 23 is about 1.0±0.1Ω. Others are unchanged and will not be repeated here.

Example 7

Figure 15:
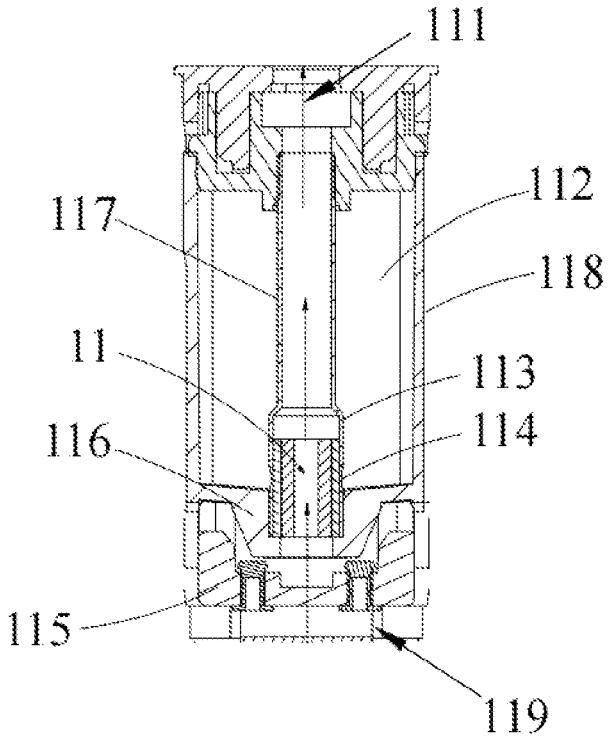
FIG. 15 is a schematic diagram of an atomizer comprising one through hole according to one embodiment of the disclosure.

As shown in FIG. 15, the disclosure also provides an atomizer comprising an atomization body. One end of the atomization body comprises a vapor outlet 111. The atomization body comprises an e-liquid chamber 112. A vapor guide tube 117 is disposed in the e-liquid chamber 112. A first end of the vapor guide tube 117 communicates with the vapor outlet 111. The ceramic heating core of any one of examples 1-4 is disposed in the vapor guide tube 117. The through hole 11 of the ceramic heating core communicates with the vapor guide tube 117. Abase 115 is disposed on the other end of the atomization body. The base comprises an air inlet 119 which communicates with the through hole 11.

The atomization body further comprises an e-liquid tank 118. The e-liquid chamber 112 is in the e-liquid tank 118. The vapor outlet 111 is disposed on one end of the e-liquid tank 118, and the base 115 is disposed on the other end of the e-liquid tank 118. The vapor guide tube 117 is disposed in the e-liquid chamber 112 and communicates with the vapor outlet 111.

An e-liquid inlet 114 is disposed on a second end of the vapor guide tube 117 near the ceramic heating core. An e-liquid seal 116 is disposed on the second end of the vapor guide tube 117 for sealing the e-liquid chamber. The e-liquid seal 116 comprises a through hole and the vapor guide tube 117 is disposed through the through hole. The e-liquid seal 116 is disposed on the base 115.

FIG. 15 shows the airflow direction when the atomizer is working. When a user inhales, a negative pressure forms in the vapor guide tube, and the air flow enters the through hole 11 of the ceramic heating core through the air inlet 119 from outside. The effective heating section 23 of the heating wire 21 heats the e-liquid to produce vapor, and the air flow drives the vapor to flow out from the through hole 11 along the vapor guide tube 117 to the vapor outlet 111, so that the user smokes.

Example 8

Figure 16:
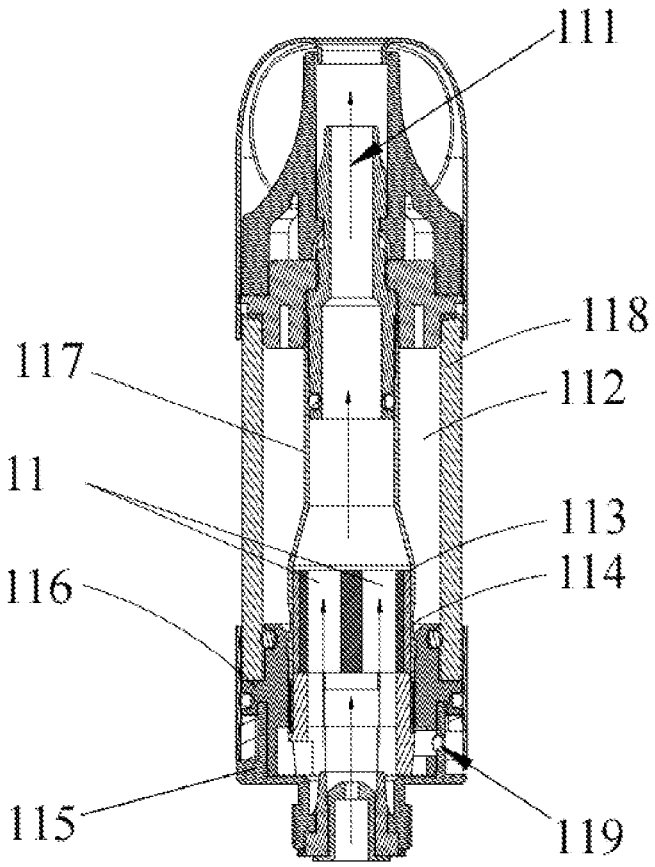
FIG. 16 is a schematic diagram of an atomizer comprising two through holes according to one embodiment of the disclosure.

As shown in FIG. 16, the atomizer of the example is basically the same as that in Example 7, which is not repeated herein. The ceramic heating core of example 5 or 6 is disposed in the vapor guide tube to heat the e-liquid, and the vapor is generated by heating the e-liquid in the effective heating section 23 of the two through holes 11.

Example 9

As shown in FIGS. 1-7, an electronic cigarette of the disclosure comprises an atomizer of example 7 or 8 and a battery module. The battery module comprises a battery to supply power for the heating wire 21 of the ceramic heating core.

It will be obvious to those skilled in the art that changes and modifications may be made, and therefore, the aim in the appended claims is to cover all such changes and modifications.

The invention claimed is:

1. A ceramic heating core, comprising:

a ceramic body, the ceramic body comprising a through hole having a central axis defining an axial direction; and a heating wire disposed through the through hole; wherein:

the heating wire comprises an effective heating section; wherein the effective heating section is adapted to vaporize an e-liquid to produce vapor;

the effective heating section extends helically in the through hole;

the effective heating section is wound into a helix having a plurality of turns;

the through hole is adapted for conveying the vapor out of the ceramic core;

the effective heating section has an axial height of 3.5-4.7 mm along the axial direction;

the ceramic body has an axial height of 7.5-9 mm along the axial direction;

the effective heating section comprises 2.5-5.5 turns; and the effective heating section is partially embedded in the ceramic body whereby a part of each cross-section of the effective heating section is exposed out of the ceramic body, wherein the thickness of the part that is exposed out of the ceramic body is less than ⅓ of the diameter of the heating wire.

2. The ceramic heating core of claim 1, wherein the effective heating section comprises a heating monofilament; and a total resistance of the effective heating section is 0.5-1.8Ω.

3. The ceramic heating core of claim 2, wherein the effective heating section comprises two parallel-connected heating monofilaments; and the effective heating section has an axial height of 3.7-4.3 mm.

4. The ceramic heating core of claim 3, wherein the through hole has a diameter of 1.3-1.7 mm; the effective heating section comprises 4.3-5.5 turns; and the total resistance of the effective heating section is 0.5-1.8Ω.

5. The ceramic heating core of claim 4, wherein the through hole has a diameter of 1.4-1.6 mm; the effective heating section comprises 4.7-5.3 turns; and the total resistance of the effective heating section is 1.5-1.7Ω.

6. The ceramic heating core of claim 3, wherein the through hole has a diameter of 1.8-2.2 mm; the effective heating section comprises 2.5-4.2 turns; and the total resistance of the effective heating section is 1.1-1.4Ω.

7. The ceramic heating core of claim 6, wherein the through hole has a diameter of 1.9-2.1 mm; the effective heating section comprises 2.6-3.0 turns; and the total resistance of the effective heating section is 1.2-1.4Ω.

8. The ceramic heating core of claim 6, wherein the through hole has a diameter of 1.9-2.1 mm; the effective heating section comprises 3.7-4.2 turns; and the total resistance of the effective heating section is 1.2-1.4Ω.

9. The ceramic heating core of claim 6, wherein the through hole has a diameter of 1.8-2.2 mm; the effective heating section comprises 2.5-4.0 turns; and the total resistance of the effective heating section is 0.5-1.2Ω.

10. The ceramic heating core of claim 9, wherein the through hole has a diameter of 1.9-2.1 mm; the effective heating section comprises an axial height of 3.7-4.2 mm; the effective heating section comprises 3.2-3.8 turns; and the total resistance of the effective heating section is 0.5-0.8Ω.

11. The ceramic heating core of claim 9, wherein the through hole has a diameter of 1.9-2.1 mm; the effective heating section comprises an axial height of 4.0-4.5 mm; the effective heating section comprises 2.8-3.0 turns; and the total resistance of the effective heating section connected in parallel is 0.9-1.2Ω.

12. The ceramic heating core of claim 2, wherein the ceramic body comprises two through holes; the effective heating section in each of the two through holes comprises a heating monofilament; and the heating monofilaments in the two through holes are disposed in parallel.

13. The ceramic heating core of claim 2, wherein two ends of the effective heating section are connected to a first pin and a second pin through solder joints, respectively; and a resistivity of the heating monofilament is 10-100 times that of the first pin or the second pin.

14. An atomizer, comprising the ceramic heating core of claim 1.

15. An electronic cigarette, comprising the ceramic heating core of claim 1.

* * * * *